US009133629B2

(12) United States Patent
Copeland et al.

(10) Patent No.: US 9,133,629 B2
(45) Date of Patent: Sep. 15, 2015

(54) VERTICAL ENCLOSURE SAFETY APPARATUS

(76) Inventors: Tim Copeland, Murrayville, GA (US); Tony Wiley, Dawsonville, GA (US)

( * ) Notice: Subject to any disclaimer, the term of this patent is extended or adjusted under 35 U.S.C. 154(b) by 0 days.

(21) Appl. No.: 13/207,228

(22) Filed: Aug. 10, 2011

(65) Prior Publication Data

US 2012/0037452 A1 Feb. 16, 2012

Related U.S. Application Data

(60) Provisional application No. 61/372,512, filed on Aug. 11, 2010.

(51) Int. Cl.
*E04F 19/10* (2006.01)

(52) U.S. Cl.
CPC ..... *E04F 19/10* (2013.01)

(58) Field of Classification Search
CPC ..... E04G 3/24
USPC ..... 182/128, 223, 222
See application file for complete search history.

(56) References Cited

U.S. PATENT DOCUMENTS

| | | | | |
|---|---|---|---|---|
| 3,038,555 | A * | 6/1962 | Da Lee et al. | 182/83 |
| 3,289,788 | A * | 12/1966 | Evans et al. | 182/128 |
| 4,323,140 | A * | 4/1982 | Foscarini et al. | 182/128 |
| 5,295,557 | A * | 3/1994 | Taylor | 182/222 |
| 6,009,975 | A * | 1/2000 | Coenders | 182/128 |
| 6,668,977 | B2 * | 12/2003 | Arsenault | 182/187 |
| 6,830,127 | B2 * | 12/2004 | Johnson | 182/113 |
| D656,442 | S * | 3/2012 | Hanks et al. | D12/194 |
| 2002/0100429 | A1 * | 8/2002 | Wade | 119/452 |
| 2009/0236180 | A1 * | 9/2009 | Grandy | 182/128 |
| 2010/0032240 | A1 * | 2/2010 | Rodriguez Fernandez | 182/222 |

* cited by examiner

*Primary Examiner* — Katherine Mitchell
*Assistant Examiner* — Candace L Bradford
(74) *Attorney, Agent, or Firm* — Baker & Hostetler LLP

(57) ABSTRACT

A safety apparatus adapted for retrofitting vertical enclosures is shown. The safety apparatus may include a support frame, a grate platform, and telescoping support legs adapted to fasten to an enclosure wall. The apparatus may also include a hinged hatch defining an opening configured to allow a person to be pulled through the platform.

19 Claims, 3 Drawing Sheets

VERTICAL ENCLOSURE SAFETY APPARATUS

CROSS-REFERENCE TO RELATED APPLICATION

This application claims the benefit of priority of U.S. provisional patent application No. 61/372,512 filed, Aug. 11, 2010, the contents of which are herein incorporated by reference

BACKGROUND OF THE INVENTION

The present invention generally relates to safety equipment, and more particularly, to a vertical enclosure safety apparatus.

Existing vertical enclosures, for example, man holes with a ladder system, include concrete slabs with port holes. The slabs are placed at intervals to catch a workman should he/she slip and fall. One reason for falling is that the slabs can trap noxious gases that overwhelm the workman while descending into the man hole. When falling onto a lower slab, a workman may be knocked unconscious or killed. Sometimes, the prone workman comes to a rest out of the line of sight of the port hole. During rescue of a workman, a lifeline may be tied to the workman so that he/she is pulled up. When the body is out of line of sight, raising of the workman may perilously encounter the unyielding concrete slabs from underneath with little visual guidance.

As can be seen, there is a need for an apparatus that can allow a prone person to be lifted out of an enclosure safely. There is also a need for an apparatus that can adaptively be retrofit into an existing enclosure. Additionally, it can be seen that a need exists for an apparatus that mitigates the trapping of noxious gases in an enclosure.

SUMMARY OF THE INVENTION

In one aspect of the present invention, safety apparatus comprises a platform; a support frame disposed on an underside of the platform; a hatch attached to a portion of the platform, wherein the hatch is adapted to allow a person to pass through the platform and the support frame; and a plurality of telescopic support legs attached to the support frame configured to telescope co-planar to the support frame.

In another aspect of the present invention, a safety apparatus comprises a support frame adapted to secure onto surrounding walls of a vertical enclosure; a platform disposed over the support frame; a hatch in the platform; an arched wall of the hatch defining an opening between an enclosure side wall and the platform, wherein an apex of the arched wall is disposed proximate the center of the of the platform; and a hinge coupled to the hatch, the hinge configured to pivot the apex of the arched wall upward.

In still yet another aspect of the present invention, a safety apparatus comprises a support frame adapted to secure against surrounding walls of a vertical enclosure; a grate platform attached to the support frame; and an upwardly opening hatch including a wall defining an opening, the hatch and wall configured to allow a person to be lifted through the opening and the hatch.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims. Various inventive features are described below that can each be used independently of one another or in combination with other features.

Broadly, embodiments of the present invention generally provide a safety apparatus for use in vertical enclosures. A vertical enclosure in this disclosure generally means any confined walled enclosure, typically taller than a person that is climbed into or out of with a ladder. For example, a vertical enclosure can be a sewage man hole, a silo, or a companionway of a seafaring vessel.

Figure 1:
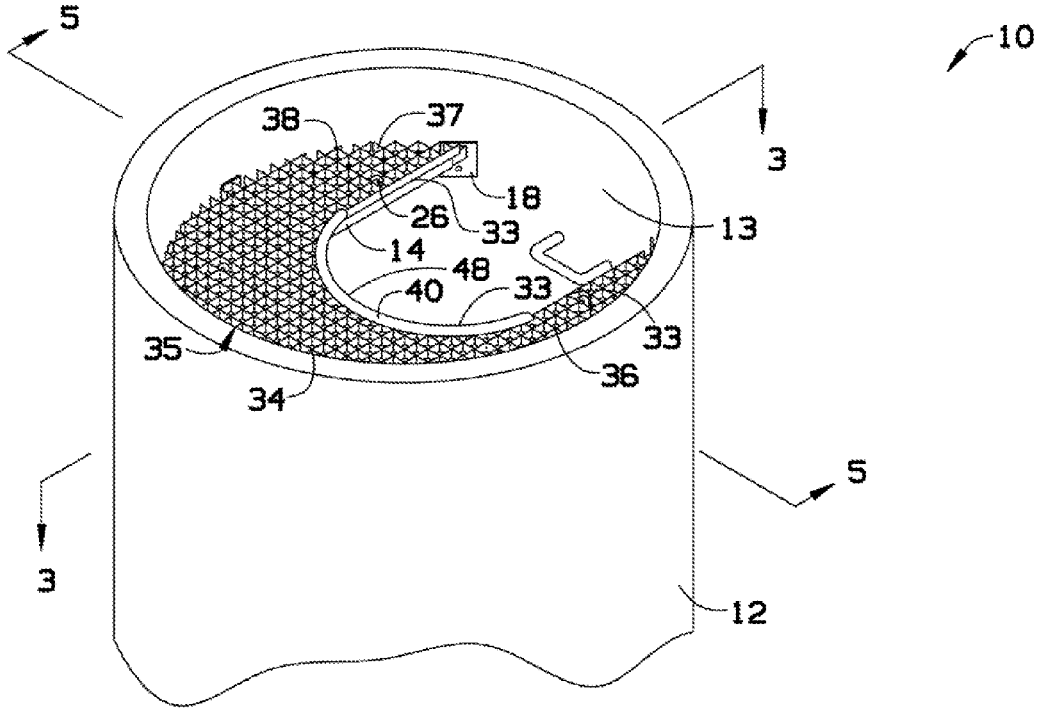
FIG. 1 is a perspective view of a safety apparatus in accordance with an exemplary embodiment of the present invention.
Figure 2:
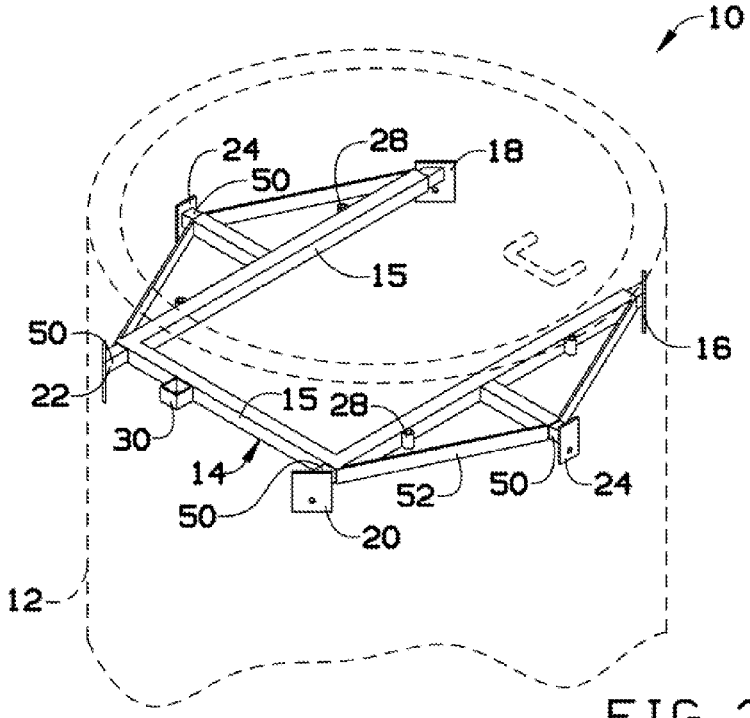
FIG. 2 is a perspective view of a support frame used in the safety apparatus of FIG. 1.
Figures 6, 7:
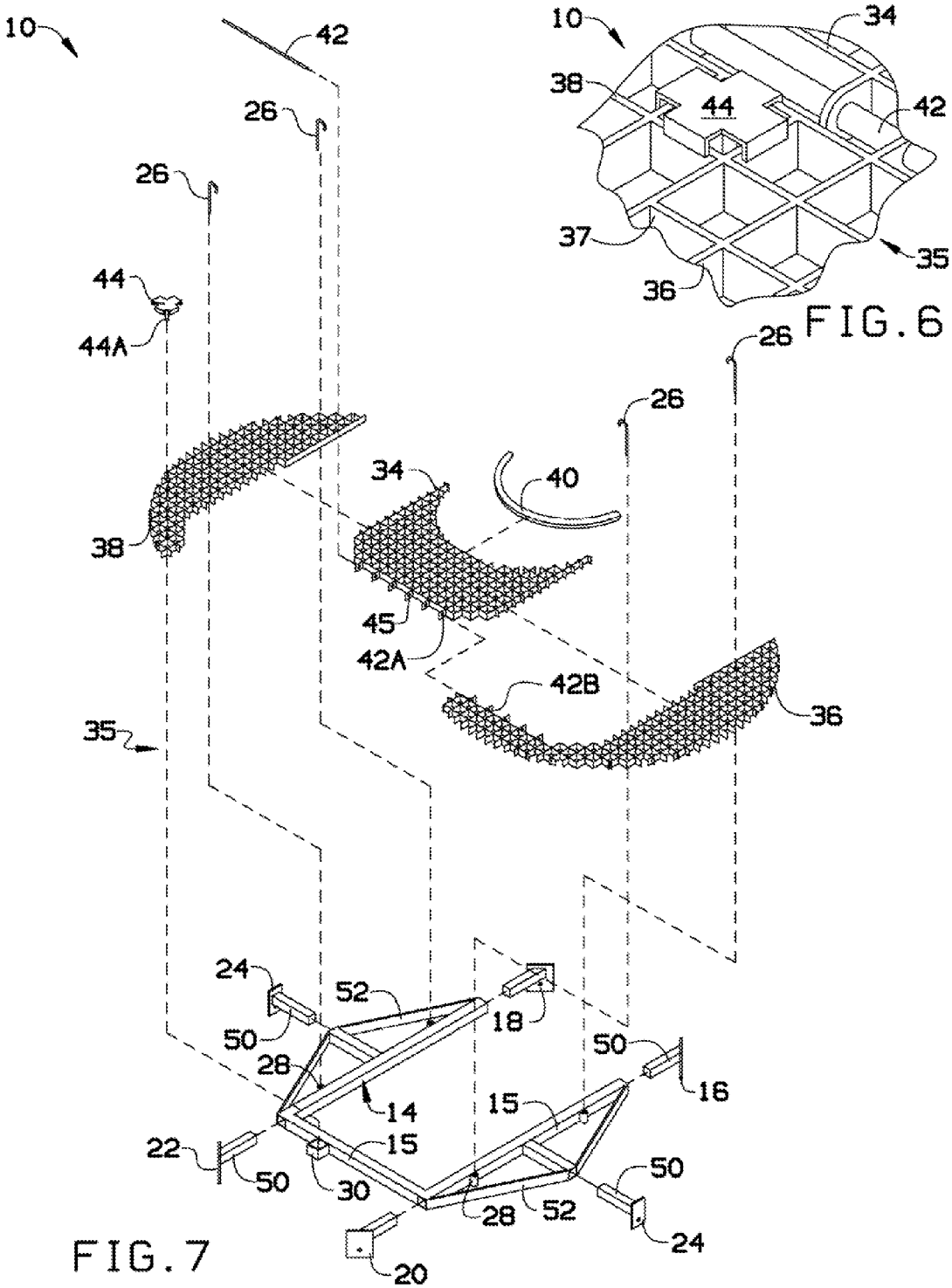
FIG. 6 is an enlarged perspective detail of a platform locking cap.
FIG. 7 is an exploded view of the safety apparatus of FIG. 1.

Referring now to FIGS. 1, 2, and 7, a safety apparatus 10 is shown. The safety apparatus 10 includes a support frame 14, a platform 35, and a hatch 34. In one aspect, the safety apparatus 10 may provide facilitated installment to the internal sidewalls 13 of now existing vertical enclosures 12.

The support frame 14 may be attached to an underside of the platform 35. The support frame 14 may be a tubular frame, made for example, from stainless steel box tubing. The support frame 14 may include box rails 15 disposed in a generally open-ended rectangular frame. Angled support rails 52 may project at an acute angle from opposite ends of a box rail 15, where two support rails 52 may meet and form a junction on a side of the support frame 14. The support frame 14 may also include telescopic support legs 50 on the ends of box rails 15 and at the junctions of the support rails 52. The telescopic support legs 50 may be configured to project co-planar to the rest of the support frame 14. Distal ends of telescopic support legs 50 may include fastening brackets 16, 18, 20, 22, and 24 respectively. The fastening brackets 16, 18, 20, 22, and 24 may be angled from distal ends of the telescopic support legs 50 for attachment to a curved sidewall 13. In another exemplary embodiment, the horizontal box rail 15 connected between the vertically disposed box rails 15 may be adapted to telescope laterally. This feature may provide convenience in permitting the support frame 14 to pass through, for example, a manhole ring and/or cover.

The platform 35 may be attached co-planar to the disposition of the support frame 14. The platform 35 may be a grate or grid type body including, grid walls 37 defining 1 inch by 1 inch grid openings. The platform 35 may be made from a molded fiberglass resin, for example, Chemgrate™. It may be appreciated that embodiments using the grate style platform 35 include a grid of openings that allow potentially noxious gases to flow out, yet the fiberglass resin can support over 600 pounds and withstand corrosion from the environment.

In one exemplary embodiment, where a vertical enclosure 12 is generally tubular, the platform 35 is generally round. The platform 35 may include separable portions, including side portions 36 and 38, and a central portion 34, (also referred to as hatch 34 as described more fully in the disclosure to follow). Internal edges of the platform portions 34, 36, and 38 may be configured to form an arched wall 33, defining a generally U-shaped opening between the platform 35 and the sidewall 13. The U-shaped opening may be an access way adapted to allow a person's body to pass substantially through. An apex 48 of the arched wall 33 may be disposed past the center of the platform 35 relative to its position from the sidewall 13. An internal edge of the central portion 34 may include a safety edge tubing 40 surrounding the edge. It may be appreciated that the telescopic horizontal box rail 15 may permit adjustable alignment of the hatch 34 over the support frame 14. A platform locking bracket 30 may couple a rear edge 45 (opposite the arched wall apex 48) of the platform 35 to the support frame 14.

Figure 3:
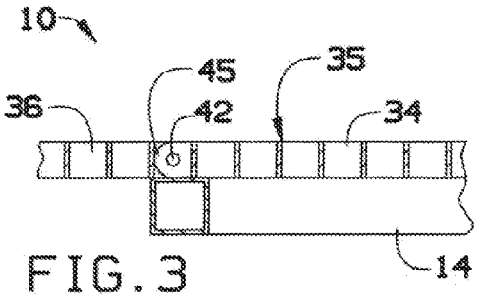
FIG. 3 is a cross section detail view of the safety apparatus taken along line 3-3 of FIG. 1.
Figure 4:
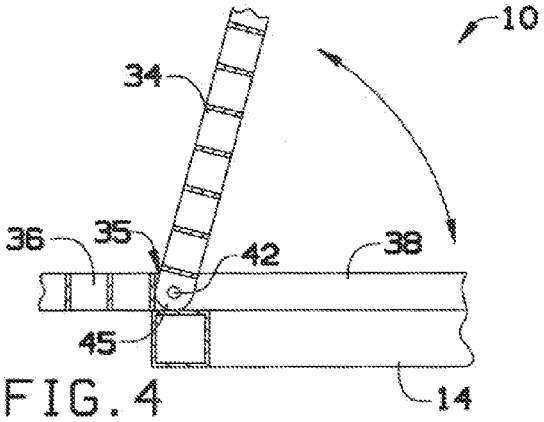
FIG. 4 is a cross section detail view illustrating a pivot action of the safety apparatus of FIG. 3.

Referring now to FIGS. 3-4 and 7, enlarged views of a pivoting mechanism for the hatch 34 are shown. The hatch 34 may include a hinge 42 coupled to the rear edge 45 of the platform 35. The hinge 42 may pass in alternating fashion through hinge point holes 42*a* located on the grating of the rear edge 45 and hinge point holes 42*b* on platform portion 36. The hinge 42 may be configured to allow the hatch 34 to pivot so that the apex 48 (FIG. 1) moves upward from the hinge. The hinge 42 may be positioned on the platform 35 close to an adjacent sidewall 13 so that the sidewall 13 is disposed to act as a doorstopper.

Figure 5:
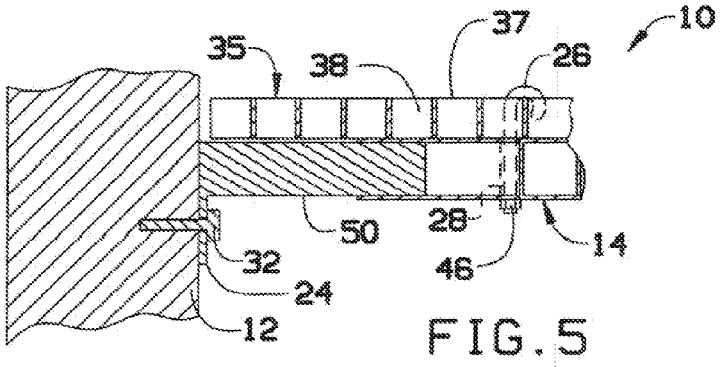
FIG. 5 is a cross section detail view of the safety apparatus anchored to an exemplary environment and of a connection between a support frame and platform taken along line 5-5 of FIG. 1.

Referring now to FIGS. 5-7, exemplary embodiments showing coupling of the platform 35 to the support frame 14 are shown. In exemplary embodiments using a grate or grid style platform 35, a plurality of J-hooks 26 may be inserted through openings of the platform portions, 36, and 38 interlocking the top of grid walls 37 into J-hook brackets 28 that are attached to the support frame 14. A platform locking cap 44 may lock the platform 35 into the support frame 14. In one exemplary embodiment, an elongated screw 44*a* may be connected to an underside of the cap 44 and extend downward through the platform 35, into and through the locking bracket 30 where it may be secured by a nut or similar fastener. The fastening bracket 24, (as well as similar brackets 16, 18, 20, and 22 shown, for example, in FIGS. 2 and 7) may be fastened to the sidewall 13 using, for example, 0.5 inch stainless steel wedge anchors 32.

Figure 8:
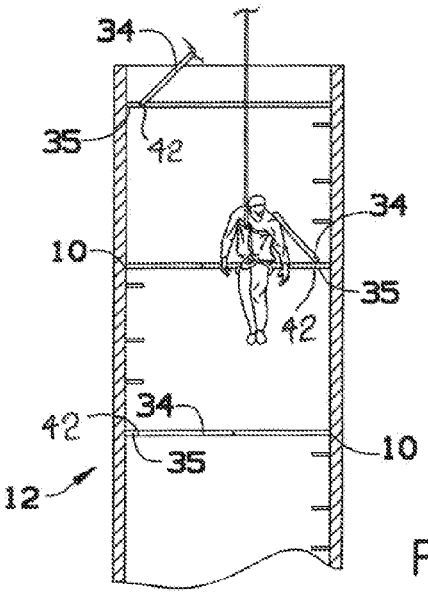
FIG. 8 is a perspective view illustrating an exemplary system using multiple safety apparatuses of FIG. 1.

Referring now to FIGS. 1 and 8, an exemplary environment and application illustrating use the safety apparatus 10 is shown. The vertical enclosure 12 shown is an existing man hole retrofitted with a plurality of an exemplary embodiment of the safety apparatus 10. The safety apparatuses 10 may be anchored into the enclosure 12 spaced 6 to 8 feet apart. For sake of illustration, the length of each hatch 34 is not shown to scale. In one aspect, the plurality of safety apparatuses 10 are disposed in alternating fashion so that the hatch 34 of one apparatus 10 may be offset approximately 180 degrees from a hatch 34 above or below it and is at least partially below the opening or access way of an apparatus 10 above it. Thus, a person who may have fallen from one apparatus 10 may be intercepted by the platform 35 of the next apparatus 10. During rescue of an injured person below a safety apparatus 10, the person, hooked up to a rescue line may have a visible line of sight by rescuers and be pulled carefully up and through an overlying safety apparatus access way. If the person encounters the underside of the platform 35, the hinged hatch 34 will freely pivot upward; the person may slide over the safety edge tubing 40 and pulled through the safety apparatus 10. When the person is pulled through, the position of the hinge 42 provides enough travel for the hatch 34 to rise up yet, automatically be pulled back downward by gravity to its default position, safely re-covering that area of the enclosure.

It should be understood, of course, that the foregoing relates to exemplary embodiments of the invention and that modifications may be made without departing from the spirit and scope of the invention as set forth in the following claims.

What is claimed is:

1. A safety apparatus, comprising:

a platform;

a U-shaped support frame comprising three rails, said support frame being open at one end with respect to an internal sidewall of a vertical enclosure, said support frame disposed on an underside of the platform;

a hatch attached to a portion of the platform, said hatch having a hinged edge portion, said hinged edge portion cooperatively engageable with said platform, and said hatch having an inwardly curved, U-shaped opening formed by said hatch opposite said hinged edge portion, such that an apex of said U-shaped opening is disposed toward a body of said hatch and further disposed in an approximate geometric center of said platform, and such that lateral ends of said U-shaped opening disposed within said hatch extend distally away from said hinged edge portion of said hatch, wherein said hatch is adapted rotate away from said platform in order to allow a person to pass through said platform and said support frame; and a plurality of telescopic support legs attached to the support frame configured to telescope co-planar to the support frame; wherein said support frame further comprises first and second triangular portions bounding opposite sides of said support frame, each said triangular portion taking the form of an isosceles triangle, a respective base of each said isosceles triangle comprising one of said sides of said support frame, each said triangular portion further comprising a structural member interconnecting said base and an apex of said isosceles triangle between legs thereof, each said base disposed to carry a respective angled bracket adjacent each respective end of said base, said structural member interconnecting said base and said apex disposed to carry a respective bracket adjacent an end thereof, a face of each said respective bracket lying approximately perpendicular to said structural member and parallel to said base.

2. The safety apparatus of claim 1, wherein the telescopic support legs include brackets configured to attach to internal sidewalls of a vertical enclosure.

3. The safety apparatus of claim 2, wherein the brackets are attached angled from distal ends of the telescopic support legs.

4. The safety apparatus of claim 1, wherein the platform includes separable portions adapted for interlocking attachment to the support frame.

5. The safety apparatus of claim 1 wherein said platform further comprises a first section disposed to cooperatively adjoin a second section, each of said first and second sections respectively comprising a curvilinear outer boundary, a straight portion providing clearance for said hatch, and a lateral portion extending therefrom toward said cooperatively adjoinable section.

6. The safety apparatus of claim 5 wherein said lateral portion of said first section extends further than said lateral portion of said second section.

7. The safety apparatus of claim 5 further comprises a platform locking cap for locking said platform to said support frame.

8. The safety apparatus of claim 1 wherein said platform comprises grid openings sufficient to allow noxious gasses to pass through said platform.

9. The safety apparatus of claim 1 wherein said hatch further comprises safety edge material adjacent said apex of said U-shaped opening disposed within said hatch.

10. A safety apparatus, comprising:

a U-shaped support frame adapted to secure onto a surrounding sidewall of a vertical enclosure, said support frame comprising three rails and being open and unbounded at one end with respect to the surrounding sidewall of the vertical enclosure;

a platform disposed over the support frame;

a hatch in the platform, said hatch comprising a hingeable edge portion, said hingeable edge portion cooperatively engageable with said platform, and an opening defining an inwardly curved arched wall formed by said hatch opposite said hinged edge portion, such that an apex of said arched wall of said opening is disposed toward a body of said hatch and further disposed in an approximate geometric center of said platform, and such that lateral ends of said arched wall extend distally away from said hinged edge portion of said hatch;

said arched wall of the hatch defining an opening between an enclosure side wall and the platform; and a hinge coupling said hatch to said platform, the hinge configured to allow pivot of the apex of the arched wall upward.

11. The safety apparatus of claim 10, wherein the arched wall is sized to allow a person to fit through the opening.

12. The safety apparatus of claim 10, wherein the platform is a grate including grid walls defining grid openings between the grid walls.

13. The safety apparatus of claim 10 wherein said support frame further comprises first and second triangular portions bounding opposite sides of said support frame, each said triangular portion taking the form of an isosceles triangle, a respective base of each said isosceles triangle comprising one of said sides of said support frame, each said triangular portion further comprising a structural member interconnecting said base and an apex of said isosceles triangle between legs thereof, each said base disposed to carry a respective angled bracket adjacent each respective end of said base, said structural member interconnecting said base and said apex disposed to carry a respective bracket adjacent an end thereof, a face of each said respective bracket lying approximately perpendicular to said structural member and parallel to said base.

14. The safety apparatus of claim 10 wherein said platform further comprises a first section disposed to cooperatively adjoin a second section, each of said first and second sections respectively comprising a curvilinear outer boundary, a straight portion providing clearance for said hatch, and a lateral portion extending therefrom toward said cooperatively adjoinable section.

15. A safety apparatus, comprising:

a support frame comprising three rails adapted to secure against a surrounding wall of a vertical enclosure, said support frame being open and unbounded at one end with respect to the surrounding wall;

a grate platform attached to the support frame; and an upwardly opening hatch including a wall defining an inwardly curved, U-shaped opening disposed within said hatch, such that an apex of said U-shaped opening is disposed toward a body of said hatch and further disposed in an approximate geometric center of said grate platform, and such that lateral ends of said U-shaped opening of said hatch extend distally away from said apex of said U-shaped opening and away from a center of said hatch, said hatch and wall configured to allow a person to be lifted through said opening and said hatch.

16. The safety apparatus of claim 15, wherein the hatch includes grid walls defining grid openings.

17. The safety apparatus of claim 15, wherein the grate platform is made from fiberglass resin.

18. The safety apparatus of claim 15 wherein said support frame further comprises first and second triangular portions bounding opposite sides of said support frame, each said triangular portion taking the form of an isosceles triangle, a respective base of each said isosceles triangle comprising one of said sides of said support frame, each said triangular portion further comprising a structural member interconnecting said base and an apex of said isosceles triangle between legs thereof, each said base disposed to carry a respective angled bracket adjacent each respective end of said base, said structural member interconnecting said base and said apex disposed to carry a respective bracket adjacent an end thereof, a face of each said respective bracket lying approximately perpendicular to said structural member and parallel to said base.

19. The safety apparatus of claim 15 wherein said grate platform further comprises a first section disposed to cooperatively adjoin a second section, each of said first and second sections respectively comprising a curvilinear outer boundary, a straight portion providing clearance for said hatch, and a lateral portion extending therefrom toward said cooperatively adjoinable section.

* * * * *